United States Patent [19]

Saegusa

[11] Patent Number: 4,518,332

[45] Date of Patent: May 21, 1985

[54] OIL PUMP

[75] Inventor: Yasuyoshi Saegusa, Hyogo, Japan

[73] Assignee: Sumimoto Electric Industries, Ltd., Osaka, Japan

[21] Appl. No.: 436,024

[22] Filed: Oct. 22, 1982

[30] Foreign Application Priority Data

Oct. 22, 1981 [JP] Japan ..... 56-169732

[51] Int. Cl.[3] ..... F04C 2/10

[52] U.S. Cl. ..... 418/150; 418/171

[58] Field of Search ..... 418/171, 150

[56] References Cited

U.S. PATENT DOCUMENTS

| | | | |
|---|---|---|---|
| 2,475,242 | 7/1949 | Iavelli | 418/171 |
| 2,490,391 | 12/1946 | Wentling | 418/171 |
| 2,965,039 | 12/1960 | Morita | 418/150 |
| 3,129,875 | 4/1964 | Cirillo | 418/150 |
| 3,955,903 | 5/1976 | de Dobo | 418/150 |

FOREIGN PATENT DOCUMENTS

| | | | |
|---|---|---|---|
| 148992 | 11/1980 | Japan | 418/171 |
| 148991 | 11/1980 | Japan | 418/171 |

*Primary Examiner*—William R. Cline
*Assistant Examiner*—John J. McGlew, Jr.
*Attorney, Agent, or Firm*—Wenderoth, Lind & Ponack

[57] ABSTRACT

An oil pump using internal gearing, wherein the difference in number of teeth between the internal and external gears is one, and wherein the inner rotor is directly connected to the crankshaft of the internal combustion engine or to the transmission shaft. The inner rotor is formed from a trochoidal curve and tracking circle which the outer rotor is formed from a trochoidal curve theoretically ideal for the inner rotor but modified by having circularly arched inwardly curved portions so as to decrease confinement of the inner rotor and smooth the operation thereof.

1 Claim, 7 Drawing Figures

OIL PUMP

BACKGROUND OF THE INVENTION

Hitherto, it has been customary with oil pumps for internal combustion engines that in pumps of the type having direct connection to the engine, internal gearing of involute tooth including an outer rotor 3 having teeth 1 and an inner rotor 4 having teeth 2 profile as shown in FIG. 1 is employed and that where internal gearing of trochoid tooth profile is employed operation is carried out by reducing the number of revolutions through an idle gear or a belt pulley. Recently, fuel cost saving in internal combustion engines has been widely recognized as a vital need, and the same has now been called for with respect to oil pumps as well.

In the internal gear pump having an involute tooth profile, a crescent 5 which is structurally necessary as such is a major cause of lowering mechanical efficiency, with volumetric efficiency $\eta_v=60\sim80\%$, mechanical efficiency $\eta_m=15\sim30\%$, and total efficiency $\eta=10\sim25\%$ being typical under a normal operating pressure of $5\sim6$ Kg/cm$^2$. In, in the internal gear pump having a trochoid tooth profile, if the crescent is eliminated, the following efficiencies are obtainable under a comparable operating pressure: volumetric efficiency $\eta_v=90\sim100\%$, mechanical efficiency $\eta_m=30\sim60\%$, and total efficiency $\eta=30\sim60\%$.

However, the trouble with a conventional internal gear pump having a trochoid tooth profile is that if it is operated at a high rotational speed in the same manner as one having direct connection to the engine, cavitation is likely to take place, or eccentric wear due to high speed is likely to develop.

OBJECT AND SUMMARY OF THE INVENTION

The invention is intended to provide a solution to these problems. Accordingly, it is a primary object of the invention to provide a low cost oil pump for a fuel cost saving internal combustion engine. To this end, the invention provides an oil pump using internal gearing, characterized in that the difference in number of teeth between the internal and external gears is one, there being no crescent, and in that the inner rotor is directly connected to the crankshaft of the internal combustion engine or to the transmission shaft.

The advantages of the invention are explained below.

The first advantage is that as compared with a conventional internal gear pump of involute tooth profile, the oil pump of the invention exhibits higher total efficiency under normal operating pressure of 30 kg/cm$^2$ or below, thus providing economy in fuel cost. For example, as against total efficiency $\eta=15\%$ of the interal gear pump with an involute tooth profile in the medium speed range of $2000\sim4000$ rpm under an operating pressure of $5\sim6$ kg/cm$^2$, the pump according to the invention exhibits total efficiency $\eta=40\%$, which means a 25% increase in the efficiency of the engine as a whole in the case of a 100 horsepower engine.

The second advantage is that the need for machining cost for the crescent is eliminated, which fact reduces the cost of the oil pump.

Another advantage is that reduction means such as an idle gear or a pulley is not required, so that the pump can be made lighter in weight and less expensive.

A further advantage is that no cavitation is likely to take place, nor is any drop in mechanical efficiency likely to develop. Furthermore, improved mechanical efficiency due to direct connection is expectable.

BRIEF DESCRIPTION OF THE DRAWINGS

One form of oil pump embodying the invention will now be described with reference to the accompanying drawings, in which.

DETAILED DESCRIPTION OF THE PREFERRED EMBODIMENTS

Figure 6:
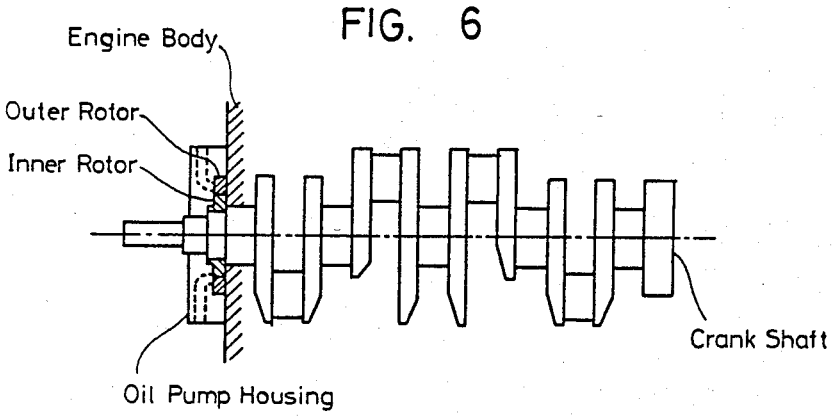
FIGS. 6 and 7 are schematic illustrations of the crankshaft, internal combustion engine and transmission shaft of the oil pump shown in FIG. 5.
Figure 7:
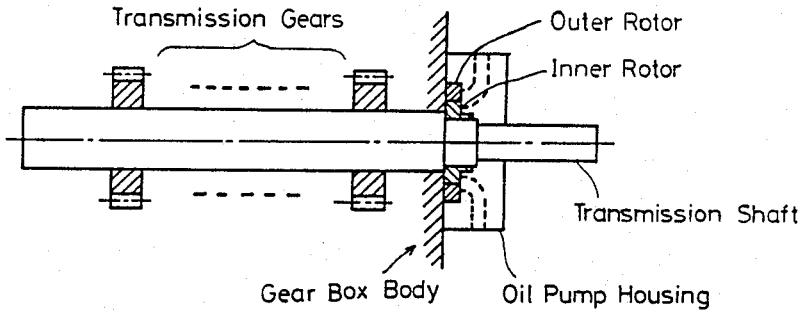

FIGS. 6 and 7 respectively illustrate the crankshaft of an internal combustion engine and the crankshaft of an oil pump, each having an inner rotor 7 and an outer rotor 6 in accordance with the invention.

Figure 3:
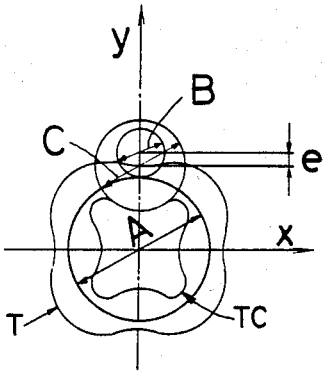
FIG. 3 is an explanatory view showing the manner in which the involute tooth profile of the inner rotor is determined based on various trochoidal curve elements.

1. A curve pattern based on a trochoidal curve or phantom trochoidal curve TC having 8 or more inner teeth is used as the tooth profile of the inner rotor of the rotary pump of the invention. In FIG. 3 which is an explanatory view showing various elements of a trochoidal curve wherein $\phi$A is the base circle diameter, $\phi$B is the rolling circle diameter, $\phi$C is the track circle diameter, and e is the amount of eccentricity. As is well known for obtaining such a curve pattern, that the curve TC of an inner tooth profile is obtained by first rolling the rolling circle on the base circle to obtain the trochoidal curve T which is the path followed by a point at a radial distance e (the eccentricity of the inner rotor relative to the outer rotor) from the center of the rolling circle during the rolling, and then forming a curve TC such that when the track circle rolls along it, the center of that track circle traces the curve T.

2. In accordance with this invention the ratio of the amount of eccentricity e to the rolling circle diameter $\phi$B is selected in the range $0.4\sim0.5$, and the ratio of the track circle diameter $\phi$C to the rolling circle diameter $\phi$B is selected in the range $0.5\sim3.0$.

Through these arrangements 1 and 2 it is possible to avoids such troubles as cavitation and eccentric wear in high speed rotation.

Another feature of the invention is that the number of outer teeth is one more than the number of inner teeth. By this arrangement it is possible to eliminate crescent 5.

Figure 1:
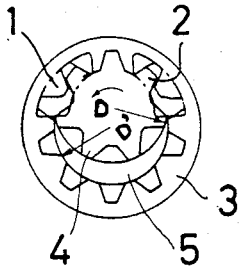
FIG. 1 PRIOR ART
FIG. 1 is a schematic illustration showing an internal gear pump having involute tooth profile.
Figure 2:
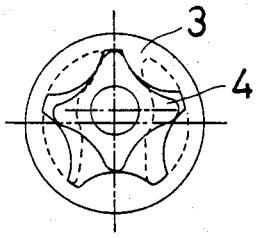
FIG. 2 PRIOR ART
FIG. 2 is a schematic illustration showing a conventional internal gear pump having a trochoid tooth profile.
Figure 4:
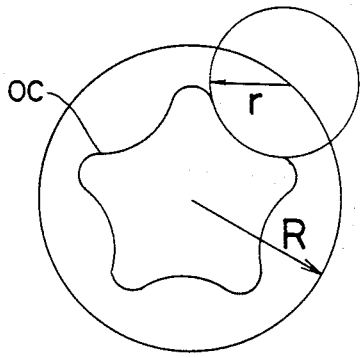
FIG. 4 is an explanatory view showing the manner in which the tooth profile of the outer rotor based on various outer curve elements.

FIG. 4 is an explanatory view showing various outer curve elements utilized to determine the tooth profile of the outer rotor in accordance with the invention. The outer curve OC is based on a combination of a circular arc and the trochoidal curve theoretically ideal for the selected inner tooth profile of the inner rotor, the circular arc tooth profile having some adjustment relative to the theoretical values.

That is, the inwards arcs are initially replaced by circular arcs of radius r centered at a radial distance R from the center of the outer curve OC where the distance between the centers is R, and the radius of the circular arc is r, and their respective values are then adjusted by amounts are $\Delta R$ and $\Delta r$, $\Delta R=0\sim+0.08$ mm and $\Delta r=0\sim-0.08$ mm.

In FIG. 4, the inner rotor 7 has a larger diameter a and a smaller diameter b, and outer rotor 6 has a larger diameter c and a smaller diameter d. In the theoretically ideal outer rotor the radial extent of the teeth $(c-d)/2$is the same as that of the inner rotor $(a-b)/2$ and the larger diameter a is smaller than the larger diameter c by the extent of each tooth, $(a-b)$. Thus, $c=(3a-b)/2$ and $d=(a+b)/2$.

Thus, it is possible to decrease the amount of confinement during operation and to obtain smooth operation.

Figure 5:
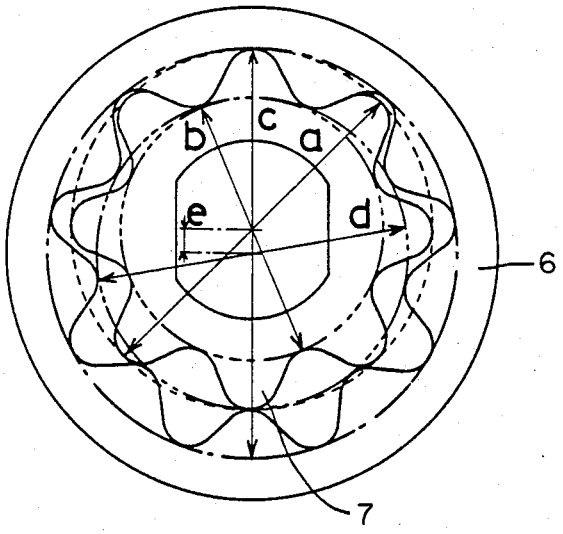
FIG. 5 is a front view showing one form of an oil pump embodying the invention.

FIG. 5 is a front view of an oil pump in accordance with the invention, wherein various elements are as follows:

Number of inner teeth: 8

Larger inner rotor diameter a: $56.296\pm0.030$ mm

Smaller inner rotor diameter b: $43.784\pm0.030$ mm

Larger outer rotor diameter c: $62.826+0.06$ mm$-0$ mm

Smaller outer rotor diameter d: $50.080+0.06$ mm$-0$ mm

Amount ofeccentricity e: 3.128 mm.

What is claimed is:

1. An oil pump, comprising:

an internal combustion engine;

a drive shaft, driven by said engine; and an inner rotor and an outer rotor surrounding said inner rotor, mounted on said drive shaft;

said inner rotor having at least eight inner rotor teeth, said outer rotor having a number of outer rotor teeth differing from the number of inner rotor teeth by one, said inner rotor having an inner rotor tooth profile formed from a trochoidal curve defined by a base circle of diameter A, a rolling circle of diameter B and an eccentricity e equal to between 0.4 and 0.5 of the rolling circle diameter B, and a track circle diameter C which is between 0.5 and 3.0 times said rolling circle diameter B;

said inner rotor being rotatable in said outer rotor in tooth meshing relation with an eccentricity equal to said eccentricity e;

said inner rotor tooth profile being bounded radially outwardly by a circle of diameter a and radially inwardly by a circle of diameter b, wherein $a=A+B-C+2e$ and $b=A+B-C-2e$;

said outer rotor having an inner surface for engaging the outer surface of said inner rotor as the inner rotor rotates eccentrically therein said inner surface having a plurality of equally spaced inwardly circularly arched portions centered at equally spaced locations on a circle of radius $R=(A+B)/2+\Delta R$ wherein $o<\Delta R\leqq0.08$ mm, each of said plurality of circularly arched portions having radius $r=(C/2)-\Delta r$, wherein $o<\Delta r\leqq0.08$ mm.

* * * * *